US006677496B2

(12) United States Patent
Netzer

(10) Patent No.: US 6,677,496 B2
(45) Date of Patent: Jan. 13, 2004

(54) PROCESS FOR THE COPRODUCTION OF BENZENE FROM REFINERY SOURCES AND ETHYLENE BY STEAM CRACKING

(76) Inventor: David Netzer, 7979 Westheimer Rd., Apt. 1408, Houston, TX (US) 77063

( * ) Notice: Subject to any disclaimer, the term of this patent is extended or adjusted under 35 U.S.C. 154(b) by 116 days.

(21) Appl. No.: 10/000,559

(22) Filed: Oct. 23, 2001

(65) Prior Publication Data

US 2003/0092952 A1 May 15, 2003

Related U.S. Application Data

(60) Provisional application No. 60/315,814, filed on Aug. 29, 2001.

(51) Int. Cl.[7] ..... C07C 4/04

(52) U.S. Cl. ..... 585/648; 585/650; 585/483; 585/323; 208/67; 208/69; 208/130

(58) Field of Search ..... 585/323, 485, 585/648, 650; 208/67, 69, 130

(56) References Cited

U.S. PATENT DOCUMENTS 3,294,857 A * 12/1966 Tokuhisa et al. ..... 585/841
3,470,085 A * 9/1969 Parker ..... 208/143
4,167,533 A * 9/1979 Raymond ..... 585/251
4,215,231 A * 7/1980 Raymond ..... 585/251
4,458,098 A * 7/1984 Antos ..... 585/660
4,806,700 A * 2/1989 Martindale ..... 585/322
5,189,233 A * 2/1993 Larkin et al. ..... 585/265
5,258,563 A * 11/1993 Gosling et al. ..... 585/322
5,856,607 A * 1/1999 Kim ..... 585/448
5,880,320 A * 3/1999 Netzer ..... 585/448
5,952,532 A * 9/1999 Durante et al. ..... 568/802

* cited by examiner

*Primary Examiner*—Walter D. Griffin

(57) ABSTRACT

A process for the coproduction of purified benzene and ethylene is provided. The method comprises providing a first mixture comprising benzene, toluene, and one or more $C_6$ to $C_7$ non-aromatics and separating the majority of the benzene and the one or more $C_6$ to $C_7$ non-aromatics from the majority of the toluene to form a second mixture containing benzene and at least a portion of the one or more $C_6$ to $C_7$ non-aromatics. Thereafter at least about 80% of the $C_6$ to $C_7$ non-aromatics in the second mixture are cracked while maintaining essentially no cracking of benzene to produce a cracked product containing ethylene, propylene and pyrolysis gasoline comprising olefins, di-olefins and benzene. The pyrolysis gasoline is preferably hydrotreated and then fractionated to form a purified benzene product comprising at least about 80 wt % benzene. The purified benzene can be used as a feed to a liquid phase or mixed phase alkylation and/or to produce ethylbenzene or cumene.

23 Claims, 1 Drawing Sheet

PROCESS FOR THE COPRODUCTION OF BENZENE FROM REFINERY SOURCES AND ETHYLENE BY STEAM CRACKING

CROSS-REFERENCE TO RELATED APPLICATION

This application claims the benefit of provisional Patent Application No. 60/315,814, filed Aug. 29, 2001.

BACKGROUND

About 50% of benzene consumption in the petrochemical industry is directed to the production of ethylbenzene, an additional about 25% is dedicated to the production of cumene, and another 15% goes toward the production of cyclohexane. About 4 to 5% of benzene is directed to the production of nitrated products. Ethylbenzene is a precursor for the production of styrene, which is a precursor for the production of polystyrene, and cumene is a precursor for the production of phenol.

Benzene is obtained from various sources. Over 55% of all benzene is attained from to petroleum refining, mostly catalytic reforming of naphtha. Additionally, over 30% of all benzene is obtained from pyrolysis gasoline resulting from steam cracking in olefins production and under 15% is obtained from coke oven gas, originated from coal, as related to iron and steel production. All the above sources are coproducers of toluene, and a significant portion of toluene is converted to benzene by either hydrodealkylation or by coproduction of xylenes.

Production of ethylene by gas crackers, mostly C2–C3 and some C4 feeds, amounts to about 40% of the world ethylene capacity. This results in a relatively small coproduction of benzene compared to benzene coproduced in naphtha and gas oil crackers, which account for 60% of the world's ethylene production capacity. A typical overall benzene yield from ethane cracking is on the order of 0.60 wt % of the ethane feed, and benzene yield from propane cracking is on the order of 3.0 wt % of the propane feed. Benzene yield resulting from naphtha cracking can range from 4 wt % to 10 wt % of the naphtha feed depending the on aromatic content of the naphtha and severity of cracking. The benzene coproduction in naphtha cracking is a coincidental production to ethylene, whereas in the present invention additional ethylene production is coincidental to benzene production. For C2/C3 cracking, any significant downstream alkylation process, such as for producing ethylbenzene, is likely to be deficient in benzene.

Ethane and propane feeds are common in North America and the Arabian Gulf. In these places, benzene produced from petroleum refining would be a major provider of the benzene needed for downstream alkylation processes while the C2/C3 feed will be the major source of ethylene.

In general, benzene of nitration grade, about 99.9 wt % along with other specifications, has been used for nearly all applications, including alkylation for producing ethylbenzene and cumene. As noted above, benzene consumed by nitration processes is under 5%. However, production of ethylbenzene by vapor phase processes as practiced in many locations would require benzene of a high purity level. In recent years, the concept of alkylation of impure benzene produced from pyrolysis gasoline with dilute ethylene in mixed phase alkylation has been proposed, for example, in U.S. Pat. Nos. 5,880,320, 5,977,423 and 6,252,126. The concept of using impure benzene to produce cumene was suggested in U.S. Pat. No. 6,177,600. U.S. Pat. Nos. 5,750,814 and 6,002,057 disclose laboratory scale evidence that catalysts such as zeolite beta or zeolite Y are suitable for mixed phase alkylation of a dilute benzene stream, such as 30 wt % at about 370° F. with dilute ethylene such as 20 vol %. Alkylation of impure benzene with propylene and heavy olefins is disclosed as well.

U.S. Pat. Nos. 6,177,600 and 6,252,126 disclose a method of recovering benzene with over 80% purity, and preferably over 92% purity, where the impure benzene to be used for production of either ethylbenzene or cumene. The impure benzene was formed by hydrotreating and fractionating pyrolysis gasoline, typically containing 30 wt % benzene. Methyl-cyclo-pentane, cyclohexane and di-methyl-pentates account for the bulk of the impurities. An article in May 99 issue of Hydrocarbon Processing entitled: "Integrate ethylbenzene production with an olefins plant" discusses that impurities could consist of 75% Cyclo —C6 and 25% of C7, mostly di-methyl-pentates. All of these C6/C7 components are known to form azeotropes with benzene, and thus separation of cyclohexane and di-methyl-pentanes by conventional fractionation is impossible.

The conventional method of benzene purification and separation from the above azeotropes is by aromatic extraction or extractive distillation processes, such as UOP's Sulfolane, Lurgi's Arosolvan, IFP's DMSO processes and Uhde's Morphylane extractive distallation process. These processes, which are known to be expensive, result in a high recovery of aromatics while producing benzene at purity of over 99.9 wt %. The purity of the benzene is an important issue if ethylbenzene is produced by a vapor phase process resulting in alkylation at about 750° F. Non-aromatic impurities could crack under these alkylation conditions and would potentially contaminate the ethylbenzene product with undesirable alkylates such as cumene. In recent years, the industry has been shifting its mode of alkylation from zeolite vapor phase or $AlCl_3$ liquid phase to zeolite liquid phase alkylation with either polymer grade pure ethylene or dilute ethylene. The dilute ethylene may come as a coproduct from ethylene production such as ethylene-ethane grade with 60–90 vol % ethylene or ethylene-hydrogen-methane grade at concentrations of 8 to 15 vol %. The dilute ethylene for alkylation could be from fluid catalytic cracking (FCC) refinery source as well. The estimated alkylation temperature ranges from 310° F. to 530° F., depending on ethylene concentration and alkylation pressure. Industry research seems to indicate that alkylation in this temperature range will not crack the assumed non-aromatic impurities in the benzene, resulting from the application of the present invention where the purified benzene is applied. This is even more the case for alkylation below 420° F. and if the impurities are the more stable cycloparaffins, such as methyl cyclopentane or cyclohexane. The conversion of vapor phase alkylation units to liquid or mixed phase alkylation is decreasing the portion of the benzene market where nitration grade or pure benzene is mandatory. This market shift is the major driving force behind the present invention.

As mentioned above, catalytic reforming of naphtha is a major source of production of aromatics, including benzene. Typically, a straight run, full range naphtha resulting from crude oil fractionation has a boiling range of 100 to 350° F. It is recovered as a side cut from atmospheric distillation, typically about 10 to 20% of the crude oil, depending on the boiling curve of the crude oil. This naphtha undergoes further fractionation to separate a cut point of below 200° F., light naphtha. The C7+ cut, typically 75% of the original naphtha cut, undergoes hydrodesulfurization to less than 1 ppm sulfur and is used as a feed for catalytic reforming. In the catalytic reforming, desulfurized naphtha undergoes catalytic and endothermic dehydrogenation at about 850 to 1000° F. and 60 to 75 psig in 3 to 4 successive reactors equipped with interstage reheating. Aside from some cracking to C1–C5, the bulk of the naphtha is converted to aromatics, about 70 wt %, depending on the severity and characteristics of the naphtha. The balance of reforming reactor effluent is C5–C8 non aromatics, of which about 60 to 75% are iso paraffins, including di methyl pentanes. Fractionation and production of benzene with over 75 wt % purity from reformer reactor effluent by conventional distillation may become difficult because of the azeotrope forming characteristics of compounds such as di-methyl-pentanes, cyclohexane and methyl-cyclo pentane. Production of ethylbenzene or cumene from 75 wt % benzene would result in a low benzene yield due to high purge rate that would be required for non aromatics. Consequently, this would result in marginal economics.

To illustrate the conventional fractionation issue the following is a brief summary of binary, benzene and C6/C7 paraffins azeotropic chracteristics in atmospheric pressure. Pure benzene boils at 80.1° C. and pure cyclohexane at 81.4° C.

| Component | Benzene wt % | Azeotrope boiling temperature° C. |
|---|---|---|
| Cyclohexene | 85 | 79.5 |
| Cyclohexane | 55 | 77.5 |
| Methylcyclopentane | 10 | 71.5 |
| n-Hexane | 5 | 69.0 |
| 2,4 Di-methyl-pentane | 48.5 | 75.0 |
| 2,3 Di-methyl-pentane | 79.5 | 79.0 |
| 2,2 Di-methyl-pentane | 46.5 | 76.0 |
| n-Heptane | 99.3 | 80.0 |
| Tri-methyl-butane | 50.5 | 76.5 |

SUMMARY OF THE INVENTION

The present invention is directed to a process for the coproduction of purified benzene and ethylene. The method comprises providing a first mixture comprising benzene, toluene, and one or more $C_6$ to $C_7$ non-aromatics. This first mixture preferably comes from a refinery source, but can alternatively come from any other appropriate source. The majority of the benzene and the one or more $C_6$ to $C_7$ non-aromatics are separated from the majority of the toluene to form a second mixture containing benzene and at least a portion of the one or more $C_6$ to $C_7$ non-aromatics. Thereafter, at least about 80%, preferably at least about 95%, of the $C_6$ to $C_7$ non-aromatics in the second mixture are cracked while maintaining essentially no cracking of benzene to produce a cracked product containing ethylene, propylene and pyrolysis gasoline comprising $C_5$ to $C_8$ olefins, di-olefins and benzene. The pyrolysis gasoline is fractionated to form a purified benzene product comprising at least about 80 wt %, preferably at least about 98 wt %, benzene.

In accordance with the inventive method, stabilized reformate after C3/C4 and light ends removal proceeds to a deheptanizer column, producing overhead benzene rich fraction of about 100–210° F. boiling range and toluene rich as a bottom product. The key components of the fractionation are toluene, with an atmospheric boiling temperature of 231° F., and n-heptane, with an atmospheric boiling temperature of 200° F. The 100–210° F. fraction, which contains from about 12 to about 50 wt %, preferably from about 20 to about 35 wt %, benzene and essentially no toluene, xylenes and heavy C9+, aromatics, is introduced as a feed or a partial feed to a steam cracker. In accordance with the invention, the benzene in the feed goes unaffected through the cracker due to the_short residence time in the cracking coil in the furnace and without significant coking on the surface of furnace coil, which operates at about 1,525° F. This is different than_common feeds to naphtha crackers, which typically comprise 1–2 wt % benzene along with 3–5 wt % toluene, 0.5–1 wt % C8 aromatics and 3–5 wt % heavy, C9+ aromatics. It has been known that liquid feeds that are high in aromatics are more susceptible to coking than low aromatic feeds and would require more frequent decoking operations. However, benzene alone, as sole aromatic in the_feed, would not contribute to the coking associated with aromatics. It is known that the coking mechanism is driven by free radical and paraffinic chains on aromatics as well as multi ring aromatics. Therefore, benzene as such is presumed to be by far less reactive to coking. The introduction of benzene would slightly increase the firing duty in the cracking furnace and steam consumption to allow for evaporation and sensible heat losses. The pyrolysis gasoline C5–C8 cut that results from cracking this benzene rich material would be of over 75 wt % benzene, as opposed to 30 wt % benzene in normal pyrolysis gasoline. The balance contains 7 to 15 wt % toluene and C8 aromatics and 7 to 15 wt % C5 to C8 non aromatics. Downstream fractionation of the benzene results in about 98% recovery per pass, while over 90 wt % of other materials are separated, producing close to 98 wt % benzene. As noted, this benzene could be a raw material for production of ethylbenzene or cumene and perhaps even cyclohexane. The ethylbenzene could be used for production of styrene by either dehydrogenation or by coproduction of propylene oxide, which can further be polymerized to polystyrene, as is commonly known in the industry.

DETAILED DESCRIPTION

Figure 1:
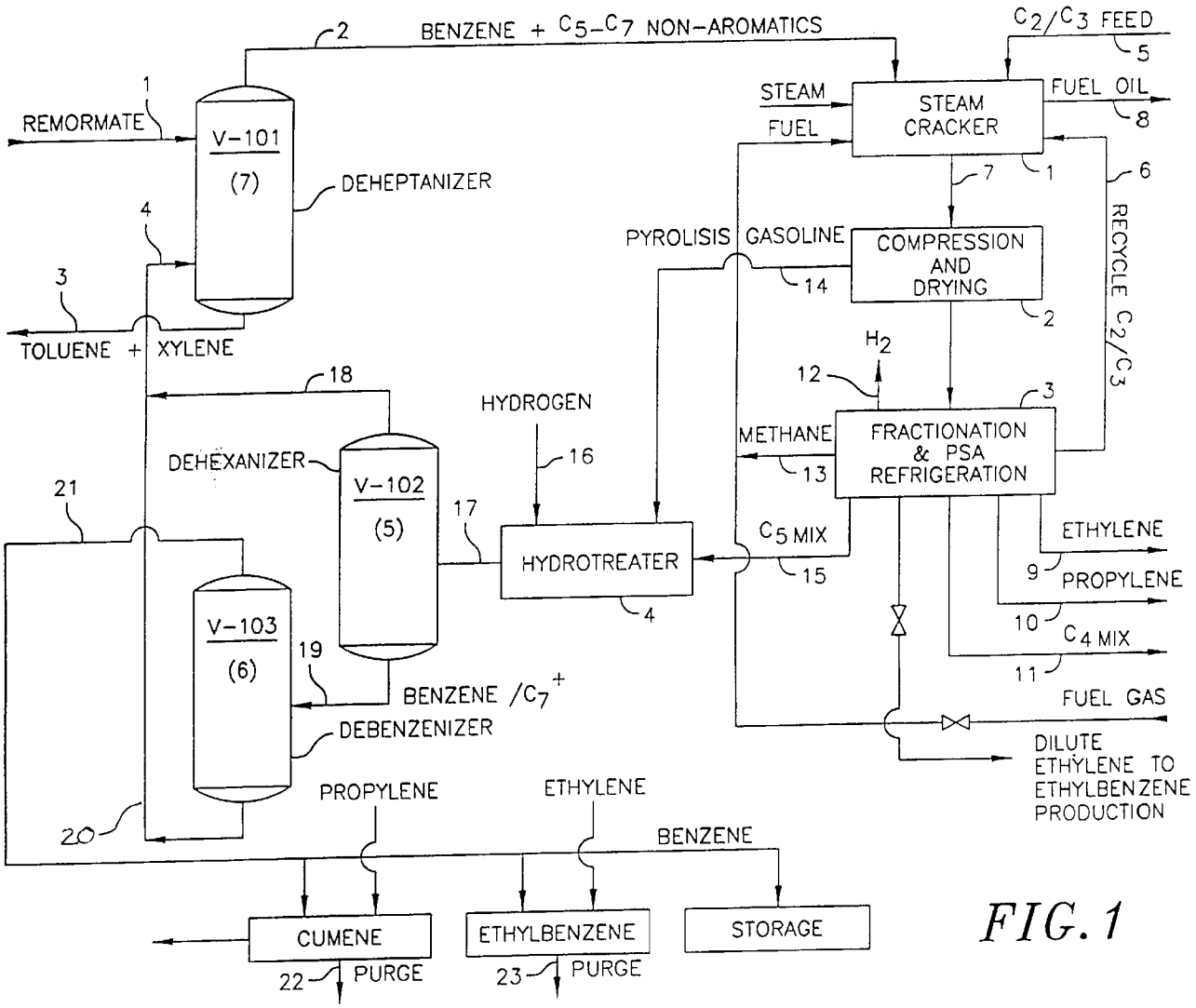
FIG. 1 is a flowchart illustrating one embodiment of the method of the invention where ethylbenzene and cumene are coproduced with olefins.

A particularly preferred embodiment of the invention is depicted in FIG. 1 and set forth below. Reformate from catalytic reforming, which is rich in benzene, toluene and C8 aromatics (Stream 1), enters a deheptanizer column V-101 (7), along with hydrotrated and benzene-depleted pyrolysis gasoline (Stream 4) resulting from ethylene production. The deheptanizer column (V-101) operates at about 20 psia at the overhead. Two products are formed in the deheptanizer columne, namely, benzene rich light reformate (Stream 2) and toluene/xylene-rich heavy reformate (Stream 3). The heavy reformate (Stream 3) can be routed to an aromatics plant, which likely to include toluene conversion to additional benzene as well as xylenes recovery.

The benzene rich light reformate (Stream 2) serves as a partial feed to the steam cracker (1), preferably a specially dedicated liquid cracking furnace if the rest of the feed comprises C2/C3. Raw materials for olefin product are also fed to the steam cracker (1), namely, a gas feed containing ethane and propane (Stream 5) and a recycle stream (Stream 6) from fractionation (3) that occurs later in the process, discussed further below, which also contains ethane and propane. Cracking of other liquid feeds, such as naphtha or gas oil, is also an option in accordance with the invention. One product from the steam cracker (1) is heavy pyrolysis fuel oil, which is separated from the cracking zone (Stream 8) and passed to a quench oil system (not shown). Another product, cracked gas containing olefins, hydrogen, methane and C2 to C6 at about 5 to 10 psig (Stream 7), is compressed in compressor coolers (2), preferably in 4 to 5 stages, to 400 to 600, preferably 520, psig, which includes intercooling, caustic wash and stripping of ethylene from the condensate. Almost all C6+ pyrolysis gasoline and much of the C5 are condensed in the compressor coolers. All light cracked material, including a portion of C5, are fractionated in a fractionation section (3), where ethylene (Stream 9) is recovered by refrigerated fractionation and propylene (Stream 10) and C4 mix (Stream 11) are each recovered by warm fractionation. Hydrogen product (Stream 12) as needed is separated from methane and CO by pressure swing adsorption (PSA). Methane rich fuel gas (Stream 13) is recovered and routed as fuel to the steam cracker (1). An outside fuel gas header (not shown) provides any fuel deficiency or accepts any excess of fuel, depending on hydrogen recovery and the overall heat balance.

Pyrolysis gasoline, C5 to C8, (Stream 14) from the compressor coolers (2) and C5 (Stream 15) from the fractionation section (3) are hydrotreated in hydrotreater (4) by hydrogent stream (Stream 16), and the resulting hydrotreated pyrolisis gasoline (Stream 17) undergoes fractionation for benzene recovery in two columns. First the pyrolysis gasoline is introduced to the dehexanizer column (5) where C5, iso C6, n-C6 and most of methyl-cyclopentane in the feed are separated as a top cut (Stream 18). The bottom product of the dehexanizer (5) which comprises benzene, cyclohexane, some methy-lyclo-pentane and almost all C7+ (Stream 19), proceeds to a debenzenizer column (6) to produce a toluene rich cut (Stream 20) and a benzene product (Stream 21). The toluene rich cut (Stream 20) combines with the top cut from the dehexanizer (Stream 18) to form the hydrotrated and benzene-depleted pyrolysis gasoline (Stream 4) that is fed to the deheptanizer V-101 (7). In a particularly preferred design, Streams 18 and 20 along with Stream 1 will enter the dehepanizer (7), which preferably has about 75 trays, at different tray locations.

The benzene product (Stream 21) proceeds to ethylbenzene production (8), cumene production (9) and/or storage for export (10) to off plot users of non-nitration grade benzene. One of the assumed alkylation products would be a purge stream of C6/C7 rich hydrocarbon from cumene and ethylbenzene production (Streams 22 and 23, respectively), which could optionally be recycled for full benzene recovery to deheptanizer (7) or directly to the cracker (1). The calculated benzene purity of benzene product is 98.35 wt % in this particular example, but can typically range from 98 to 99 wt %.

The calculated benzene production rate for this particular matieral balance is 50,000 lb/hr containing: about 0.3 wt % methyl-cyclo-pentanes, 0.6 wt % cyclohexane, 0.2 wt % n-hexane and 0.6 wt % C7, mostly di-methyl-pentanes, and 400 wt. ppm toluene The following is an exemplary material balance, where the amounts are indicated in lb/hour:

| | Stream -1 | Stream -2 | Stream-3 | Stream-4 |
|---|---|---|---|---|
| $C_4H_{10}$ | 1,370 | 1,520 | 0.0 | 150 |
| $C_5$ mix | 23,960 | 28,620 | 0.0 | 4,660 |
| n-$C_6H_{14}$ | 12,750 | 13,200 | 10 | 460 |

-continued

| | | | | |
|---|---|---|---|---|
| I-$C_6H_{14}$ | 23,700 | 24,090 | 10 | 400 |
| M-Cyclo $C_5$ | 740 | 1,235 | 5 | 500 |
| Cyclo $C_6$ | 100 | 145 | 5 | 50 |
| n-$C_7H_{16}$ | 11,750 | 10,730 | 1,180 | 160 |
| I-$C_7H_{16}$ | 21,810 | 21,940 | 20 | 150 |
| M-Cyclo $C_6$ | 220 | 65 | 235 | 80 |
| Benzene | 39,820 | 41,100 | 20 | 1,300 |
| Toluene | 128,820 | 670 | 132,030 | 3,880 |
| P-Xylene | 22,730 | 5 | 23,425 | 700 |
| O-xylene | 30,400 | 5 | 31,095 | 700 |
| M-xylene | 49,440 | 10 | 50,130 | 700 |
| EB | 21,450 | 10 | 22,190 | 750 |
| $C_8$ NA | 0 | 0 | 80 | 80 |
| $C_9$ Aromatics | 49,630 | 0 | 49,630 | 0 |
| Total | 438,690 | 143,345 | 310,065 | 14,720 |

| | Stream 5 | Stream 6 | Stream 7 | Stream -8 |
|---|---|---|---|---|
| Hydrogen | 0 | 0 | 13,650 | 0 |
| CO | 0 | 0 | 3,410 | 0 |
| Methane | 1,000 | 0 | 55,470 | 0 |
| Acetylene | 0 | 0 | 4,720 | 0 |
| Ethylene | 0 | 0 | 219,200 | 0 |
| Ethane | 183,750 | 94,500 | 94,200 | 0 |
| MAPD | 0 | 0 | 1,310 | 0 |
| Propylene | 0 | 120 | 30,350 | 0 |
| Propane | 91,000 | 6,825 | 6,820 | 0 |
| $C_4$ mix | 1,000 | 0 | 17,580 | 0 |
| $C_5$ | 0 | 0 | 4,490 | 0 |
| $C_6$ | 0 | 0 | 1,840 | 0 |
| $C_7$ | 0 | 0 | 550 | 0 |
| $C_8$ | 0 | 0 | 70 | 0 |
| Benzene | 0 | 0 | 51,340 | 0 |
| Toluene | 0 | 0 | 3,900 | 0 |
| Xylene +EB | 0 | 0 | 2,850 | 0 |
| Heavy | 0 | 0 | 0 | 10,080 |
| Total | 276,750 | 101,445 | 511,750 | 10,080 |

| | Stream -9 | Stream-10 | Stream-11 | Stream-12 | Stream -13 |
|---|---|---|---|---|---|
| Hydrogen | 0 | 0 | 0 | 7,115 | 6,100 |
| CO | 0 | 0 | 0 | 10 | 3,400 |
| Methane | 10 | 0 | 0 | 10 | 55,460 |
| Ethylene | 223,500 | 0 | 0 | 0 | 700 |
| Ethane | 300 | 10 | 0 | 0 | 10 |
| Propylene | 30 | 31,250 | 50 | 0 | 0 |
| Propane | 0 | 120 | 0 | 0 | 0 |
| $C_4$ mix | 0 | 10 | 17,530 | 0 | 0 |
| $C_5$ | 0 | 0 | 200 | 0 | 0 |
| Total | 223,830 | 31,380 | 17,780 | 7,135 | 65,670 |

| | Stream -14 | Stream-15 | Stream 16 | Stream-17 |
|---|---|---|---|---|
| Hydrogen | 0 | 0 | 280 | 0 |
| $C_4$ mix | 30 | 110 | 0 | 150 |
| $C_5$ mix | 3800 | 690 | 0 | 4,660 |
| $C_6$ mix NA | 1,800 | 40 | 0 | 1,920 |
| $C_7$ mix NA | 545 | 5 | 0 | 570 |
| $C_8$ mix NA | 70 | 0 | 0 | 70 |
| Benzene | 50,840 | 500 | 0 | 51,340 |
| Toluene | 3,890 | 10 | 0 | 3,900 |
| Xylene | 2,850 | 0 | 0 | 2,850 |
| Total | 63,915 | 1,355 | 280 | 65,460 |

| | Stream -18 | Stream-19 | Stream-20 | Stream 21 |
|---|---|---|---|---|
| $C_4$ saturated | 150 | 0 | 0 | 0 |
| $C_5$ saturated | 4,660 | 0 | 0 | 0 |
| M-Cyclo $C_5$ | 500 | 150 | 0 | 150 |
| Cyclo $C_6$ | 50 | 250 | 0 | 250 |
| I-$C_6$ | 400 | 10 | 0 | 10 |
| n-$C_6$ | 460 | 100 | 0 | 100 |
| I-$C_7$ | 50 | 320 | 100 | 220 |
| n-$C_7$ | 10 | 200 | 150 | 50 |
| $C_7$ Napht | 10 | 100 | 70 | 30 |

-continued

| | | | | |
|---|---|---|---|---|
| $C_8$ NA | 0 | 70 | 70 | 0 |
| Benzene | 1,200 | 50,140 | 100 | 50,040 |
| Toluene | 10 | 3,890 | 3,870 | 20 |
| $C_8$ aromatic | 0 | 2,850 | 2,850 | 0 |
| Total | 7,500 | 58,080 | 8,190 | 50,870 |

What is claimed is:

1. A process for the coproduction of ethylene and purified benzene comprising:

providing a first mixture comprising benzene, toluene, and one or more $C_6$ to $C_7$ non-aromatics;

separating the majority of the benzene and the one or more $C_6$ to $C_7$ non-aromatics from the majority of the toluene to form a second mixture containing at least a portion of the benzene and at least a portion of the one or more $C_6$ to $C_7$ non-aromatics, wherein the second mixture is substantially free of hydrocarbons having more than nine carbons;

introducing at least a portion of the second mixture to a cracker and thereafter cracking at least about 80% of the $C_6$ to $C_7$ non-aromatics in the portion of the second mixture that has been introduced to the cracker while maintaining essentially no cracking of benzene to produce a cracked product containing ethylene, propylene and pyrolysis gasoline comprising olefins, di-olefins and benzene; and fractionating the pyrolysis gasoline to form a purified benzene product comprising at least about 80 wt % benzene.

2. A process as claimed in claim 1, wherein the purified benzene product comprises at least about 97 wt % benzene.

3. A process as claimed in claim 1, comprising cracking at least about 95% of the $C_6$ to $C_7$ non-aromatics.

4. A process as claimed in 1, further comprising alkylating at least a portion of the benzene in the purified benzene product with ethylene to form ethylbenzene.

5. A process as claimed in claim 4, wherein the ethylene is introduced in a dilute ethylene mixture comprising ethylene in an amount ranging from about 60 to about 90 vol % and ethane.

6. A process as claimed in claim 4, wherein the ethylene is introduced in a dilute ethylene mixture comprising methane, hydrogen and less than 20 mol % ethylene.

7. A process as claimed in claim 4, further comprising converting at least a portion of the ethylbenzene to styrene.

8. A process as claimed in claim 7, further comprising converting at least a portion of the styrene to polystyrene or a derivative thereof.

9. A process as claimed in claim 1, further comprising alkylating at least a portion of the benzene in the purified benzene product with propylene to form cumene.

10. A process as claimed in claim 9, further comprising converting at least a portion of the cumene to phenol.

11. A process as claimed in claim 1, wherein the majority of the toluene, xylene and heavy aromatics are separated from the majority of the benzene and the one or more $C_6$ to $C_7$ non-aromatics by conventional fractionation in a distillation column.

12. A process as claimed in claim 1, further comprising converting at least a portion of the toluene that has been separated from the benzene to additional benzene.

13. A process as claimed in claim 12, wherein the toluene is converted to benzene by hydrodealkylation or by coproducing xylene.

14. A process as claimed in claim 12, further comprising converting to ethylbenzene at least a portion of the benzene that was converted from toluene.

15. A process as claimed in claim 14, further comprising converting at least a portion of the ethylbenzene to styrene.

16. A process as claimed in claim 15, further comprising converting at least a portion of the styrene to polystyrene or a derivative thereof.

17. A process as claimed in claim 12, further comprising converting to cumene at least a portion of the benzene that was converted from toluene.

18. A process as claimed in claim 17, further comprising converting at least a portion of the cumene to phenol.

19. A process as claimed in claim 1, further comprising hydrotreating the pyrolysis gasoline for saturation of the olefins and di-olefins.

20. A process as claimed in claim 1, wherein the benzene is present in the second mixture in an amount ranging from about 12 wt % to about 50 wt %.

21. A process as claimed in claim 1, wherein the benzene is present in the second mixture in an amount ranging from about 20 wt % to about 35 wt %.

22. A process as claimed in claim 1, further comprising converting at least a portion of the benzene to cyclohexane.

23. As process as claimed in claim 12, further comprising converting to cyclohexane at least a portion of the benzene that was produced by conversion of toluene.

* * * * *